United States Patent [19]

Melcher et al.

[11] 4,146,371

[45] Mar. 27, 1979

[54] ELECTROFLUIDIZED BED AGGLOMERATOR AND METHOD OF AGGLOMERATING

[75] Inventors: James R. Melcher, Lexington; Jeffrey C. Alexander, Belmont; Karim Zahedi, Brookline, all of Mass.

[73] Assignee: Massachusetts Institute of Technology, Cambridge, Mass.

[21] Appl. No.: 844,567

[22] Filed: Oct. 25, 1977

[51] Int. Cl.[2] ..... B03C 3/12; B03C 3/16

[52] U.S. Cl. ..... 55/10; 55/8; 55/122; 55/138; 55/DIG. 25; 55/474

[58] Field of Search ..... 55/5-8, 55/10, 77, 79, 91, 99, 122, 126, 138, 262, 338, 233, 474, 103, DIG. 25; 118/620, 630, DIG. 5; 110/28 R, 28 L, 119; 423/215.5, DIG. 16

[56] References Cited

U.S. PATENT DOCUMENTS

| | | | |
|---|---|---|---|
| 3,094,409 | 6/1963 | Renzoni et al. | 55/6 |
| 3,719,029 | 3/1973 | Terai et al. | 55/233 |
| 3,939,694 | 2/1976 | Chauvelier et al. | 55/103 |
| 3,940,237 | 2/1976 | Gonzalez et al. | 55/99 |
| 4,033,117 | 7/1977 | Smith | 55/99 |
| 4,038,049 | 7/1977 | Melcher et al. | 55/99 |
| 4,058,374 | 11/1977 | Klein et al. | 55/79 |
| 4,070,162 | 1/1978 | Koiser et al. | 55/DIG. 25 |

FOREIGN PATENT DOCUMENTS

| | | | |
|---|---|---|---|
| 8104 | 7/1932 | Australia | 55/DIG. 25 |

*Primary Examiner*—Frank W. Lutter
*Assistant Examiner*—David L. Lacey
*Attorney, Agent, or Firm*—Arthur A. Smith, Jr.; Robert Shaw

[57] ABSTRACT

An electrofluidized bed agglomerator and method of agglomerating which comprises agglomerating submicron (and/or supermicron) particulates with a liquid, said liquid acting as a bond between particulates of the agglomerate thus formed to maintain the integrity thereof.

8 Claims, 7 Drawing Figures

ELECTROFLUIDIZED BED AGGLOMERATOR AND METHOD OF AGGLOMERATING

The present invention relates to agglomerators which serve to agglomerate particulates in the submicron and supermicron size ranges.

Attention is called to U.S. Pat. Nos. 3,755,122 (Melcher et al.), 4,038,049 (Melcher et al.), and 4,038,052 and an application for Letters patent Ser. No. 781,599, filed Mar. 28, 1977 (Melcher et al.).

The removal of submicron particulates from the effluent of stacks associated with coal burning and the like is an existing and increasingly important consideration in the energy-conscious world today. Although the system herein described is useful for removal of supermicron particulates, it makes its greatest contribution with regard to submicron size smoke, since the latter cannot economically now be removed by scrubbers, conventional precipitators and like systems—although supermicron smoke can. The present system provides a mechanism whereby particulates, submicron and supermicron in size, in the gaseous effluent from a combustion or other system, is combined or agglomerated to form an agglomerate which can be economically removed from the gaseous effluent by scrubbers, conventional precipitators and the like.

Accordingly, it is an object of the invention to provide a system to effect agglomeration of submicron particulates as well as a system to effect agglomeration of supermicron particulates.

Another object is to provide an agglomerate whose integrity is maintained so that collection thereof can be effected in conventional collectors or precipitators.

Another object is to provide a system of the foregoing type, which can be retrofitted into existing collection systems.

These and still further objects are addressed hereinafter.

The foregoing objects are achieved, generally, in a system for agglomerating particulates in a gas stream that further includes entrained liquid droplets. Means is provided for charging the particulates and the liquid droplets in the stream; and means is provided for moving the thusly charged particulates and liquid droplets in the gas stream through a bed of charged particles with a vertical component to fluidize the particles of the bed and create an electrofludized bed, both the particulates and the liquid droplets being collected upon the surface of the bed particles forming on said surface agglomerates of particulates with liquid bonds therebetween. The agglomerates eventually achieve a size at which the combined effects of collisions between particles and turbulent effect of the gas moving thereby serve to dislodge the agglomerates which entrain in the gas stream and are carried by the gas stream from the bed. The liquid serves as a bond between particulates of the agglomerates to maintain the integrity thereof upon leaving the bed. The flow rate of the gas stream, the amount of liquid and an applied electric field serve to control the size of the agglomerates thus formed.

The invention is hereinafter described with reference to the accompanying drawing in which.

Figure 7:
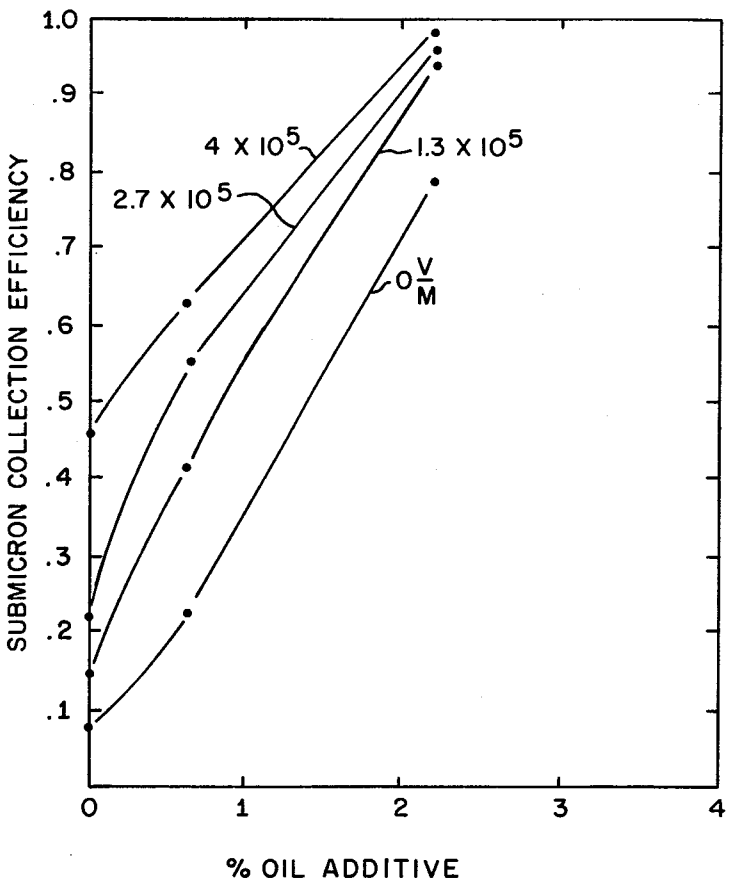
Figure 6:
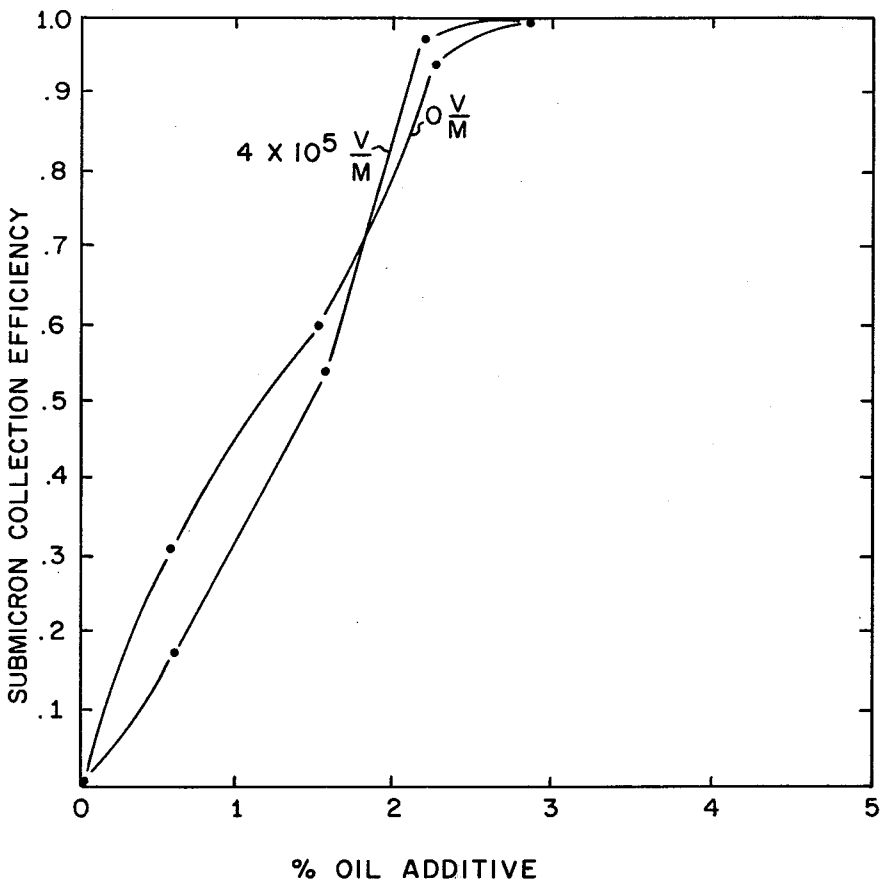

FIG. 6 is a plot of experimental results showing submicron particulate removal efficiency by an electrofluidized bed of N.J. No. 2 sand with No. 6 fuel oil additive with applied electric field as a variable; and FIG. 7 is a plot of experimental results showing submicron particulate removal efficiency by an electrofluidized bed of crushed bituminous coal with No. 6 fuel oil additive with applied electric field as a variable.

Before discussing the invention with reference to the figures, a few comments of a general nature are in order. The present inventors have found and disclose herein a novel mechanism for efficiently agglomerating particulates, especially submicron particulates, and for maintaining the integrity of the agglomerate thus formed. It is not sufficient for present purposes, as is clear in the explanation, merely to efficiently bring particulates together in the form of an agglomerate; it is necessary, as well, that the integrity of the agglomerate, thus formed, be maintained. Toward that end, the inventors provide liquid bonding between the particulates of the agglomerate. The particulate of interest is in and around the micrometer-size range (i.e., submicron and supermicron), and the liquid serves to bond particulate to particulate in the agglomerate. Throughout this explanation the term "particle" is used to denote the constituents of a bed or a fluidized bed and "particulate" is used to designate the solid constituents such as fly ash to be removed from a gaseous effluent. Whereas the particles are typically about two millimeters in average cross dimensions, the particulates are typically micrometers or less in cross dimensions.

Figure 1:
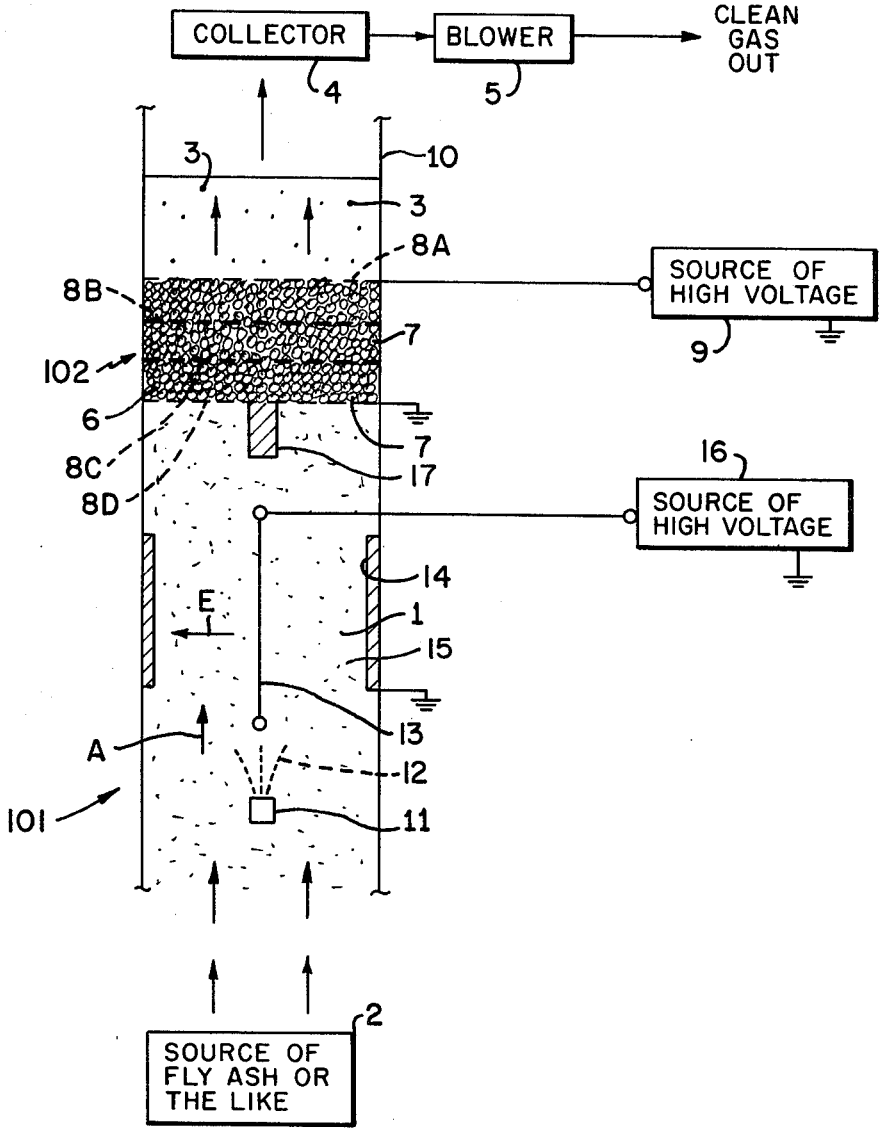
FIG. 1 is a diagrammatic representation of a system that includes an agglomerator adapted to agglomerate particulates such as fly ash and the like in a fluidized particle bed.

Turning now to FIG. 1, there is shown at 101 an electrofluidized bed agglomerator system to effect agglomeration of particulates 1. The agglomerator or agglomerator portion of the system 101 is labeled 102. The function of the agglomerator 102 is to process the particulates 1 from a source 2 of fly ash or the like to form agglomerates 3 which can then be collected by a collector 4. A blower 5 serves to provide a controllable flow rate for the gas in the system 101.

The agglomerator 102 includes a bed 6 of particles 7. The bed particles 7 are electrified by screen-like electrodes 8A, 8B, 8C and 8D that are energized by a source of high voltage 9; the electric field in the region occupied by the bed is maintained sufficiently high to effect collisions of the particulates and the liquid droplets with the particles but sufficiently low that the bed particles are not frozen by virtue of the electric field effect and sufficiently low that the agglomerates, thus formed, can escape from the bed. (Typically ~10 k-volts between, say, the electrode 8A and the electrode 8B which are spaced vertically from one another about 3 centimeters.) The lowermost electrode 8D acts also as a distributor plate which acts in concert with the housing designated 10 to keep the particles 7 within the bed region 6. A rapper 17 is used to dislodge materials that adhere to the electrode 8D.

The agglomerator 102 cn be retrofitted to exising systems wherein the source 2 may be the combustor of an electric power plant and the collector 4 a conventional Cottrel precipitator or a scrubber which, in the absence of agglomeration of submicron particulates, is not capable, within economic constraints of such systems, of removing submicron sies of particulates. In FIG. 1 the arrow shown at A is intended to denote gas flow vertically upward. The entrained fly ash from the source 2 moves upward in housing 10 past a source 11 of liquid droplets in the form of a spray represented by the broken lines 12. The gas moves through the charging section labeled 15 as a gas stream in which the particulate 1 and liquid droplets 12 are entrained. The charging section can take various forms known from the arts of electrostatic precipitation. In the embodiment of FIG. 1 the charger shown includes a center electrode 13, a wall electrode or electrodes 14 and a source of high voltage 16; the wall electrode might be circular (although not so shown in FIG. 1) so that the electric field marked E is a radial field in the region 15 within the circular cylindrical housing 10. The thusly charged particulates 1 and insulating or semi-insulating liquid droplets 12 that emerge from the charging section 15 are moved in the gas stream into the bed 6 with a vertically upward component of gas flow (the gas flow is in fact vertically upward in FIG. 1) to fluidize the bed particles 7. While in the bed region, the particulates 1 and the insulating or semi-insulating liquid droplets 12 are deposited upon the surface of the particles 7, as now explained with reference to FIG. 2 which shows greatly enlarged representations of a particle 7, etc.

Figure 2:
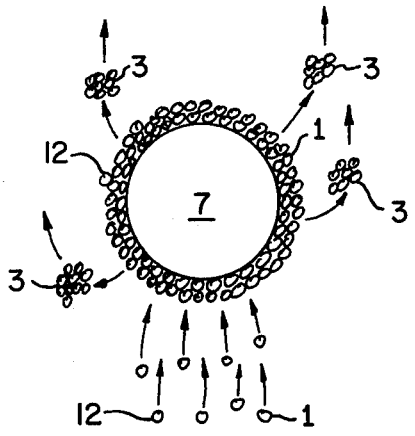
FIG. 2 is a visualization of the collection of particulates (greatly enlarged) upon a single-bed particle (greatly enlarged) to form agglomerates and the entrainment of the agglomerates (greatly enlarged) from the bed particle.

In the region below the particle 7 in FIG. 2, there are shown particulates 1 and liquid droplets 12 which deposit on the bed particle 7, as shown, to form agglomerates. The motion of bed particles in a fluidized bed is somewhat similar to rapidly boiling water, that is, there is a great deal of turbulence within the bed and, hence, the bed particles collide with one another tending to dislodge the particulates and liquid from the surface thereof. As is explained in detail hereinafter with supporting experimental evidence, this happens mostly when the agglomerates reach some critical size corresponding to a critical adhesion parameter called $S_{crit}$ hereinafter. Thus, eventually, the agglomerates achieve a size at which the combined effects of collisions between bed particles and the turbulent effect of the gas moving therethrough serve to dislodge them from the particle surface; the thusly dislodged agglomerates 3 in FIG. 2 are entrained in the gas stream and carried from the bed 6, as shown in FIG. 1. The agglomerates 3 consist of particulates and liquid, the liquid serving as a bond between particulates of the agglomerate to maintain the integrity thereof upon leaving the bed 6. The agglomerates which may be, say, 10 microns in average cross dimensions, can now be collected by a conventional collector. It will be appreciated on the basis of the foregoing explanation and what follows, that the size of the agglomerates 3 will be somewhat related to the flow rate of the gas stream and the quantity and type of liquid introduced into the stream. A more detailed explanation of the agglomerating process now follows.

An agglomerator, as above indicated, is a device which increases the size distribution of an aerosol without appreciably altering its total mass concentration. Most pollution control devices are more effective for larger sized particulates than for smaller sizes; thus agglomerators serve to improve the performance of other devices. Especially difficult to collect are submicron particulates. The electrofluidized bed has been demonstrated to collect submicron liquid particulates very efficiently (see said U.S. Pat. No. 4,038,049). With the addition of liquid additives it has been shown to also collect dry particulates (fly ash). Operating as an agglomerator, the electrofluidized bed collects particulates only as a transient followed by a steady-state in which the total mass leaving the bed is equal to the total mass entering it. Liquid additives are necessary to effect agglomeration, which takes place on a bed particle surface, but in quantities small enough that agglomerates retained in the bed reach a limiting size.

Fundamental to a determination of optimum liquid additive quantities is the present inventors' work on the adhesion of spheres to surfaces by liquid bridge forces under the dislodging action of impulsive types of forces. These impulsive forces impart an initial velocity U to a sphere simulating the particulate as it adheres to a flat surface (the bed particle); whether or not the sphere remains adhered to the surface depends on the inertia of the sphere (radius a, mass density $\rho_p$) and the viscosity $\eta$ and thickness d of the liquid bridge. An adhesion parameter S was defined $$S = \frac{U\rho_p a^{3/2}}{\eta d^{1/2}}$$

and its critical value, $S_{crit} \simeq 0.7$, was discovered by fundamental experiments. For values of S greater than about $S_{crit}$, the sphere is dislodged, while it is not for values less than $S_{crit}$.

The electrofluidized bed agglomerator necessarily involves the collection of particulates and re-entrainment of such particulates in the form of agglomerates. A model of such a process predicts the collection efficiency of any one size bed particle to be $$\eta(a) = \eta_{collection} \times \eta_{adhesion}$$

The agglomeration efficiency for any one size particulate is the product of the collection efficiency with adhesion assured $\eta_{collection}$, which depends on the parameters contributing to the bed efficiency when it is operated as a collector, and an adhesion efficiency which is the relation between the single bed particle collection and re-entrainment rates. The adhesion efficiency has been shown to correlate with the adhesion parameter, namely for $S > S_{crit}$, $\eta_{adhesion}$ is reduced.

Figure 3:
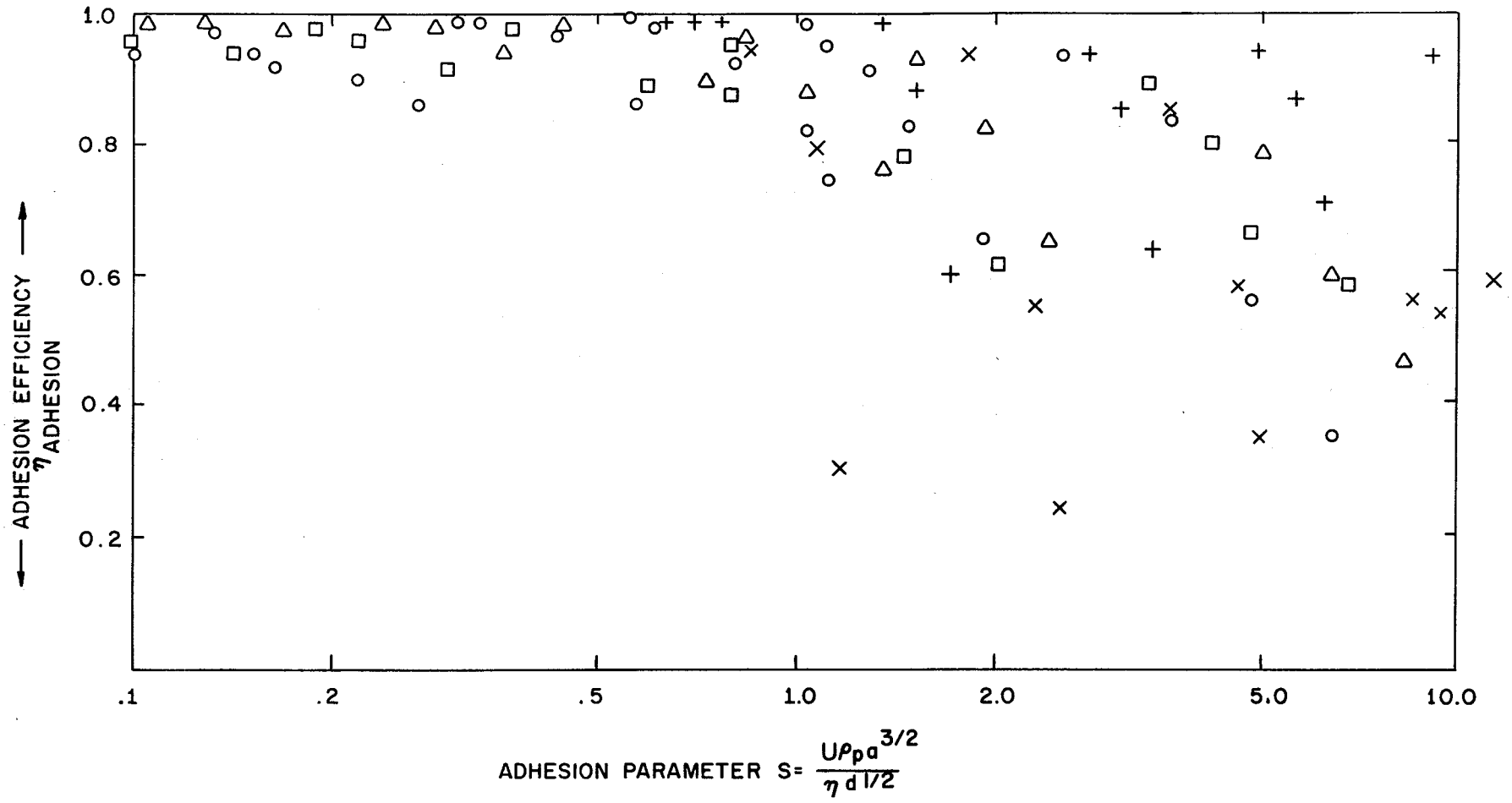
FIG. 3 is a plot of experimental results showing the hereinafter defined bed adhesion efficiency vs. the hereinafter defined adhesion parameter.

Experiments were run in which fluidized beds of N.J. No. 2 sand, Bituminous coal (−7 + 14 mesh), and sintered fly ask (−7 + 14 mesh) collected re-dispersed fly ash (geometric mean diameter of 4.7 μm, geometric standard deviation 1.9) with an oil mist (Bunker "C" No. 6 fuel oil) added. Fractional efficiencies by particle size were measured by an Anderson 2000 cascade impactor. For very small quantities of oil additive (< 1% of the fly ash by mass) erratic results were obtained. For greater quantities of oil additive, the results are summarized in FIG. 3 hereof, where adhesion efficiency vs. adhesion parameter is plotted. The data represent a range of fluidization velocities typical for proposed application. Additive viscosity was changed by varying the temperature of the gas from room temperature to 140° C., which varies the viscosity by about an order of magnitude. As can be seen, for $S \lesssim 0.7$ adhesion is good while for $S \gtrsim 0.7$ it decreases. The parameter S correlates the critical condition for entrainment of agglomerates and not the adhesion efficiency for values of S exceeding this value.

These tests tend to support the basic model for adhesion of the particulates, which can then be used to design an agglomerator system. Additive quanitites should be chosen so that the adhesion parameter for the desired outlet mean particulate size is about 0.7. Particulates less than this size will tend to be converted to entrained agglomerates greater than this size. If too much additive is used, say an amount greater than that required to adhere the largest particulate sizes, the bed will act as a collector until bed particles reach sufficient dimensions to establish steady-state. This may imply defluidization. An agglomerator operates with zero overall collection efficiency, but it will have positive fractional efficiencies for the smaller sizes and negative fractional efficiencies for the larger sizes.

Figure 5:
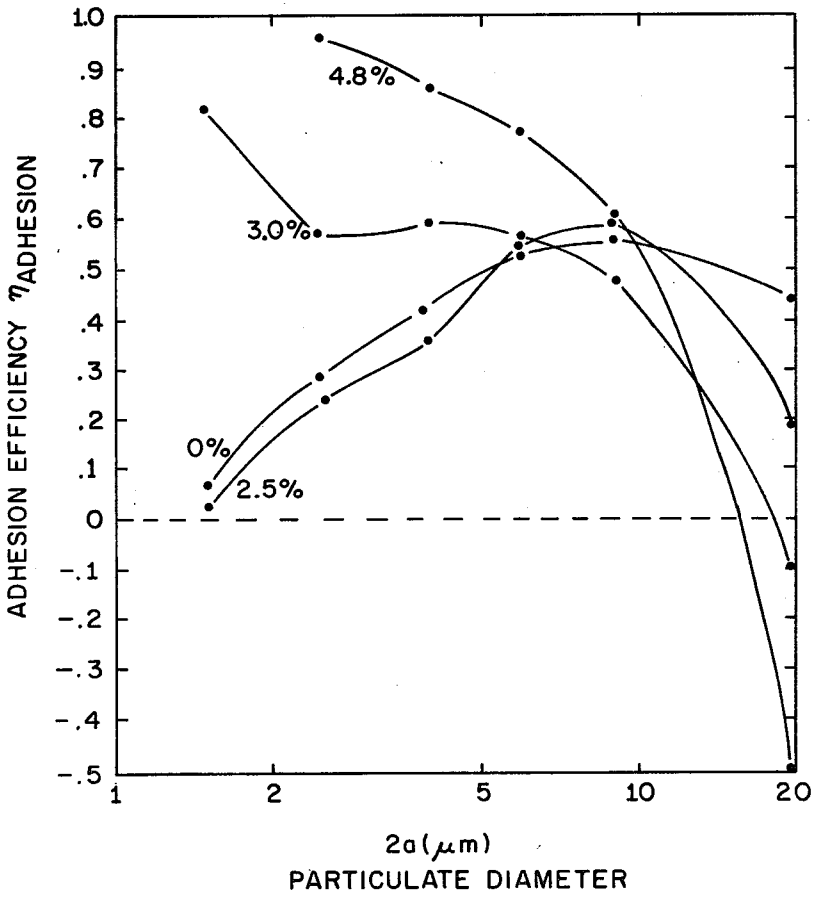
FIG. 5 is a plot of experimental results showing adhesion efficiency vs. particulate diameter for a fluidized bed agglomerating fly ash with varying amounts of No. 6 fuel oil additive, the bed being operated at 140° C. and acting as an agglomerator.
Figure 4:
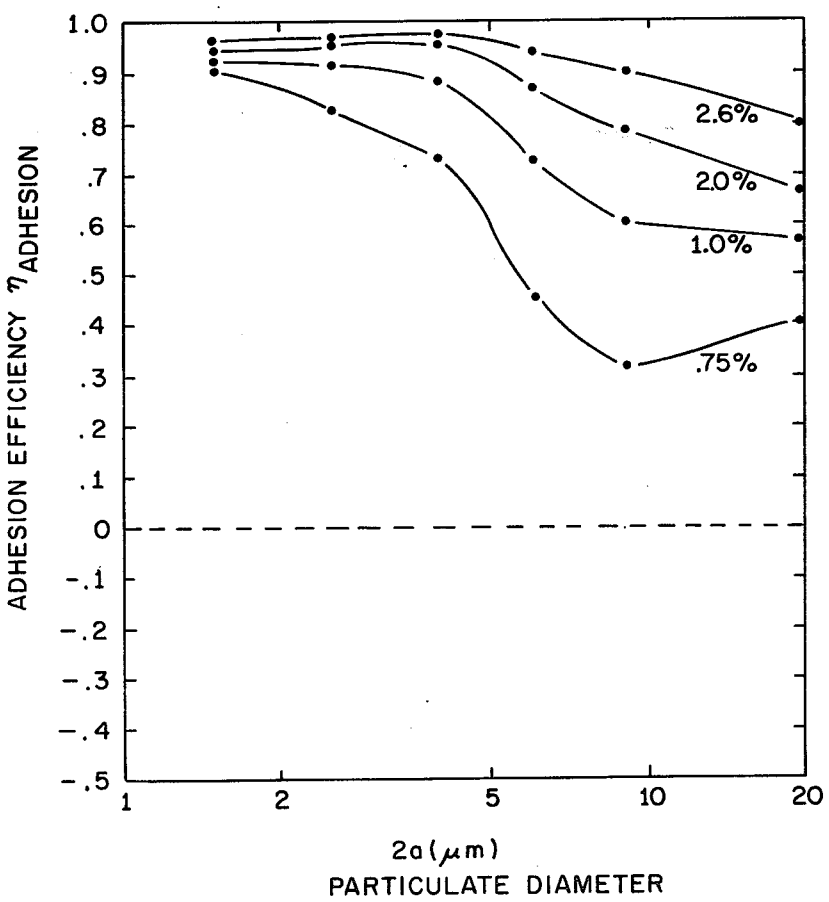
FIG. 4 is a plot of experimental results showing adhesion efficiency vs. particulate diameter for a fluidized bed collecting fly ash with varying amounts of No. 6 fuel oil additive, the bed being operated at room temperature and acting as a collector.

For the No. 6 fuel oil used, at room temperature, the beds acted principally as a collector for quantities of 2–4%, while at 140° C. (when the viscosity is an order of magnitude less) they act as agglomerators. FIG. 4 shows adhesion efficiencies as a function of particulate size for beds at room temperature, with additive amount as a parameter. FIG. 5 shows the same at 140° C. Measurement equipment sensitivity limits the results to the range $1.5\ \mu m < 2a < 20\ \mu m$, but the effect of additive is clear.

Primary concern here is with the agglomeration of the submicron particulates. Before agglomeration can occur, the particulates must be transferred from the gas to the bed particle surface. For a supermicron particulate this can be done purely by mechanical collection mechanisms, but submicron particulate must be charged and then collected in a bed with either an imposed electric field or fields generated between bed particles by frictional electrification. Experiments were done in which just the submicron efficiencies were monitored. Re-dispersed fly ash was injected into the inlet gas stream along with an oil mist. Submicron concentrations were determined by passing a sample of the gas through a small cyclone with cut diameter of about 3 μm, then through several cascade impactor stages to remove all particulates greater than 1.1 μm in size. The gas then was run through a TSI mass monitor to determine the submicron concentration. The fly ash upon re-dispersal is highly charged; so no further charging is needed. Also, the beds, especially the sand beds, develop internal fields by frictional electrification. Still, the imposed field was varied.

FIGS. 6 and 7 show the submicron collection efficiencies vs. oil additive quantities with applied field as a parameter for beds of N.J. No. 2 sand and crushed bituminous coal. These tests were done at 140° C. It can be seen that about a 2% additive of this oil is sufficient for very good submicron efficiency. FIG. 6 illustrates the frictional electrification mode of operation whereas FIG. 7 shows the imposed field mode.

It has been demonstrated for present purposes that electrofluidized beds can serve as effective agglomerators, especially in the submicron range. What is required is the transfer of the particulates to the bed particle surface, which is achieved by the electrofluidized bed high electrical collection performance and a liquid additive to promote adhesion between the particulates. Amounts of liquid additive are generally predicted by the adhesion parameter S based on fundamental models and experiments, but the complexity of the problem prevents exact specifications. Effective removal of submicron particulates has been demonstrated with agglomeration to sizes greater than 10 μm.

The experimental work has focused on a scheme where the liquid additive is added to the system externally, but depending on the application, liquids may exist in the gas stream to be controlled and such processes may require no external additives.

Modifications of the invention herein disclosed will occur to persons skilled in the art and all such modifications are deemed to be within the scope of the invention as defined by the appended claims.

What is claimed is:

1. A method of agglomerating particulates in a gas stream that further includes entrained liquid droplets that comprises: charging the particulates and the liquid droplets in the stream; moving the thusly charged particulates and liquid droplets in the gas stream through a bed of electrified particles with a vertical component to fluidize the particles of the bed and create an electrofluidized bed, both the particulates and the liquid droplets being deposited upon the surface of the bed particles forming on said surface agglomerates of particulates with liquid bonds therebetween, which agglomerates eventually achieve a size at which the combined effects of collisions between the particles and turbulent effect of the gas moving thereby serve to dislodge the agglomerates which entrain in the gas stream and are carried by the gas stream from the bed, said liquid serving as a bond between particulates of the agglomerates to maintain the integrity thereof upon leaving the bed.

2. In electrofluidized bed apparatus including housing means having a gas inlet and a gas outlet, electrified particle bed means disposed within the housing means, charging means, and means for directing a gas stream in which particulates are entrained past the charging means to charge the particulates and through the bed means with a vertical component sufficient to fluidize the particles of the bed means and create an electrofluidized bed, the improvement comprising means for causing the particulates to agglomerate on the particles of the bed and then to be carried by the gas stream from the bed, the last-mentioned means including means for entraining charged liquid droplets in the gas stream in a quantity large enough to form liquid-bound agglomerates of the particulates upon the surfaces of the bed particles but in a quantity small enough so that the agglomerates reach a limiting size, are dislodged from the bed particles by collisions between the bed particles and the turbulent effect of the gas moving therethrough, and are carried from the bed by the gas stream with the liquid serving as a bond between the particulates of the agglomerates.

3. Apparatus in accordance with claim 2, wherein the electrified particle bed means comprises means for providing an electric field in the region occupied by the particles of the bed and having an electric field intensity that effects collisions of the particulates and liquid droplets with bed particles without freezing the bed particles and without preventing escape of the agglomerates from the bed.

4. Apparatus in accordance with claim 2, wherein the means for entraining charged liquid droplets comprises means for providing insulating liquid in a quantity that provides liquid bridges between particulates of the agglomerates without allowing the bed particles to build up to the point of defluidization.

5. Apparatus in accordance with claim 2, wherein the means for entraining charged liquid droplets comprises means for providing insulating liquid of viscosity $\eta$ in an amount sufficient to provide between particulates liquid bridges of thickness d and such that $$\frac{U\rho_p a^{3/2}}{\eta d^{1/2}} \gtrsim 0.7 ,$$

where U is the initial velocity imparted by impulsive forces to a sphere of radius a and mass density $\rho_p$ representing particulate adhering to a bed particle.

6. Apparatus in accordance with claim 2, further comprising means for collecting the agglomerates after they leave the bed.

7. Apparatus in accordance with claim 2, wherein the means for entraining charged liquid droplets comprises means for providing a quantity of liquid correlated with the bed thickness, with the electric field in the bed, and with the flow rate of the gas stream through the bed such that the agglomerate sizes leaving the bed in steady-state operation of the apparatus are in a predetermined size range.

8. Apparatus in accordance with claim 2, wherein the bed particles comprise a material that can be electrified by frictional electrification and wherein electrification of the bed particles is effected by frictional electrification.

* * * * *